US010808372B2

(12) United States Patent
Wilson et al.

(10) Patent No.: US 10,808,372 B2
(45) **Date of Patent: *Oct. 20, 2020**

(54) HELICAL PILE WITH CUTTING TIP

(71) Applicant: Hubbell Incorporated, Shelton, CT (US)

(72) Inventors: Jonathan Michael Wilson, Columbia, MO (US); Timothy Michael Kemp, Columbia, MO (US); Gary Leonard Seider, Centralia, MO (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/665,782

(22) Filed: Oct. 28, 2019

(65) Prior Publication Data

US 2020/0056343 A1 Feb. 20, 2020

Related U.S. Application Data

(63) Continuation of application No. 15/343,642, filed on Nov. 4, 2016, now Pat. No. 10,458,089.

(60) Provisional application No. 62/251,728, filed on Nov. 6, 2015.

(51) Int. Cl.

| | |
|---|---|
| ***E02D 5/56*** | (2006.01) |
| ***E02D 5/28*** | (2006.01) |
| ***E02D 13/00*** | (2006.01) |
| ***E02D 7/22*** | (2006.01) |

(52) U.S. Cl.

CPC ..... *E02D 5/56* (2013.01); *E02D 7/22* (2013.01); *E02D 13/00* (2013.01)

(58) Field of Classification Search

CPC ..... E02D 5/52; E02D 5/523; E02D 5/526; E02D 5/56; E02D 5/72; E02D 5/801; E21B 10/62; E21B 10/627; E21B 10/633; E21B 2010/622; E21B 2010/624

USPC ..... 405/231, 251, 252.1, 253, 254; 175/323, 175/382, 383, 384, 394, 398, 412, 413; 52/157

See application file for complete search history.

(56) References Cited

U.S. PATENT DOCUMENTS

| | | | |
|---|---|---|---|
| 3,043,383 | A | 7/1962 | Newbold |
| 4,290,245 | A | 9/1981 | Pardue, Jr. et al. |
| 5,366,031 | A | 11/1994 | Rickards |
| 5,575,122 | A | 11/1996 | Hamilton et al. |

(Continued)

FOREIGN PATENT DOCUMENTS

| | | | |
|---|---|---|---|
| JP | 2002115250 | A | 4/2002 |
| KR | 20120126702 | A | 11/2012 |

OTHER PUBLICATIONS

International Search Report and Written Opinion mailed in corresponding application PCT/US16/60525 dated Jan. 19, 2017 (11 pages).

*Primary Examiner* — Benjamin F Fiorello
*Assistant Examiner* — Stacy N Lawson
(74) *Attorney, Agent, or Firm* — Wissing Miller LLP

(57) ABSTRACT

The present disclosure provides helical ground anchors or piles designed to cut through rock. The helical ground anchors have a shaft, one or more helical plates attached to the shaft and at least one cutting tip attached to the distal end of the shaft in order to make a first cut through rock along the axis of rotation of the shaft. The distal end of the shaft is tapered and the at least one cutting tip can be attached to the longer end of the shaft. The helical shaped plates are attached to the shaft at a distance above the at least one cutting tip.

19 Claims, 5 Drawing Sheets

(56) References Cited

U.S. PATENT DOCUMENTS

| | | | |
|---|---|---|---|
| 6,817,810 | B2 | 11/2004 | Jones |
| 8,443,918 | B2 | 5/2013 | Massari |
| 8,721,226 | B2 | 5/2014 | Baumsteiger |
| 8,727,668 | B2 | 5/2014 | Dolly et al. |
| 8,845,236 | B1 | 9/2014 | Dosdourian et al. |
| 2003/0159839 | A1 | 8/2003 | Perko |
| 2004/0028481 | A1 | 2/2004 | Pinkleton |
| 2006/0198706 | A1 | 9/2006 | Neville |
| 2007/0214735 | A1 | 9/2007 | Fujita |
| 2009/0180838 | A1 | 7/2009 | Ronnkvist |
| 2010/0263928 | A1 | 10/2010 | Massari |
| 2010/0319272 | A1 | 12/2010 | Kellner |
| 2012/0213597 | A1 | 8/2012 | Baumsteiger |
| 2013/0101360 | A1 | 4/2013 | Lutenegger |
| 2013/0272799 | A1 | 10/2013 | Suver |
| 2014/0079491 | A1 | 3/2014 | Foster et al. |
| 2014/0248092 | A1 | 9/2014 | Fallon et al. |
| 2014/0259991 | A1 | 9/2014 | Atchley et al. |
| 2015/0233075 | A1 | 8/2015 | Maggio |

Fig. 6
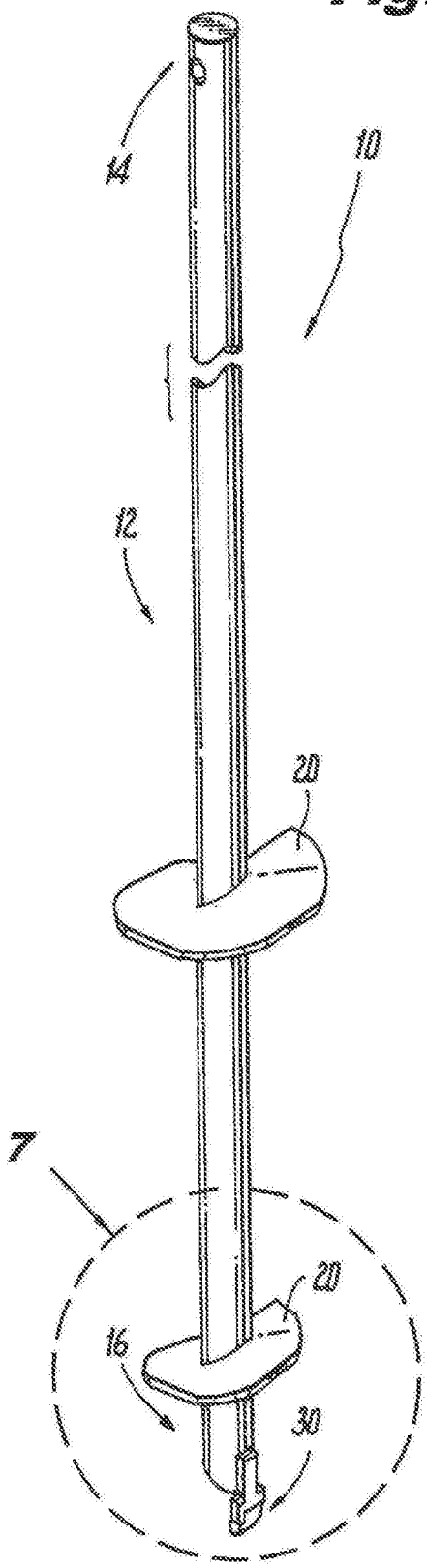
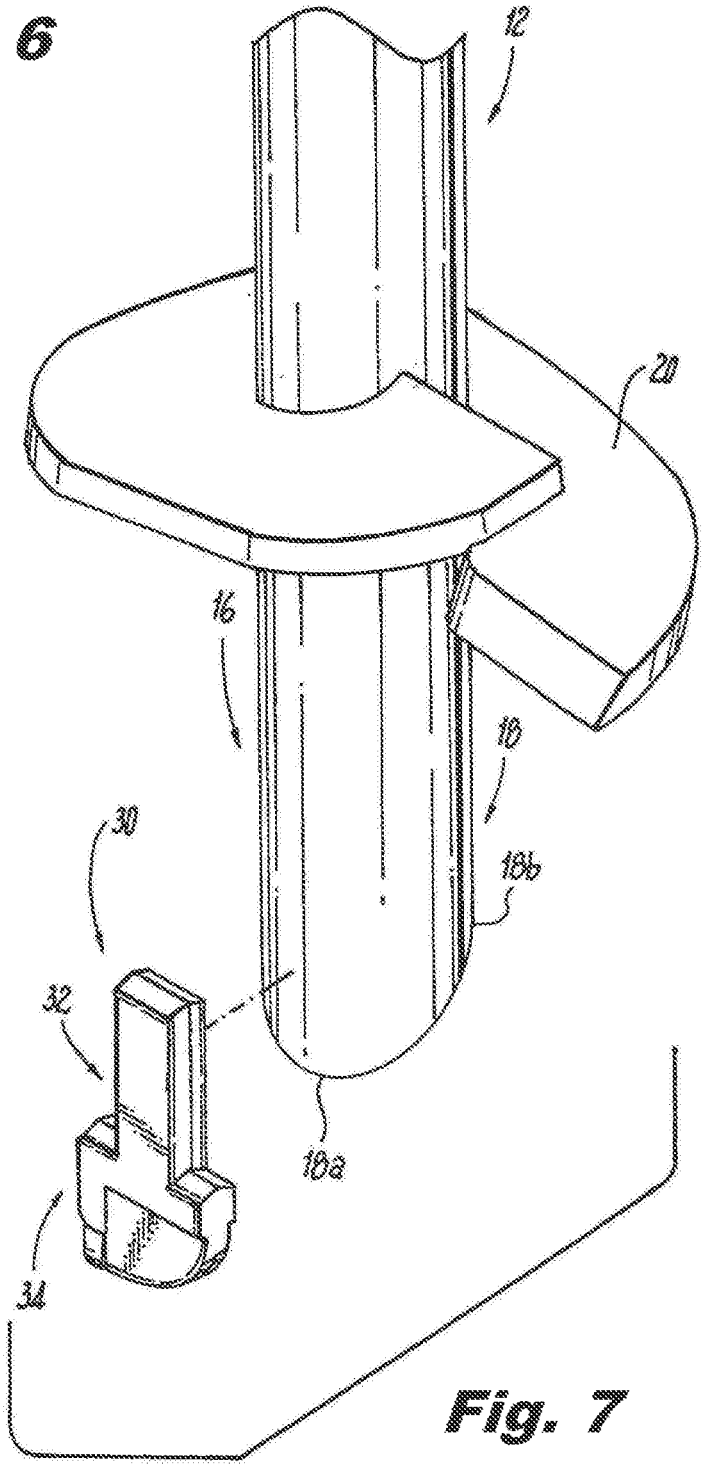
Fig. 7

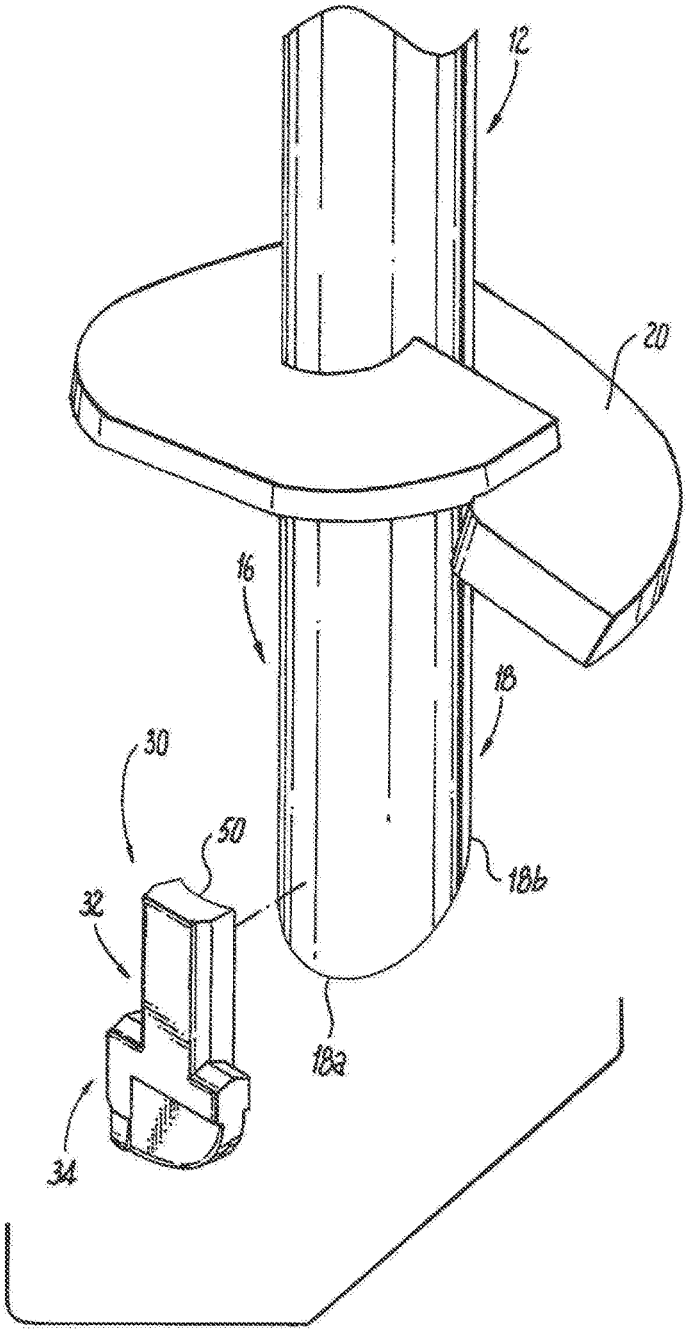
Fig. 8
Fig. 9
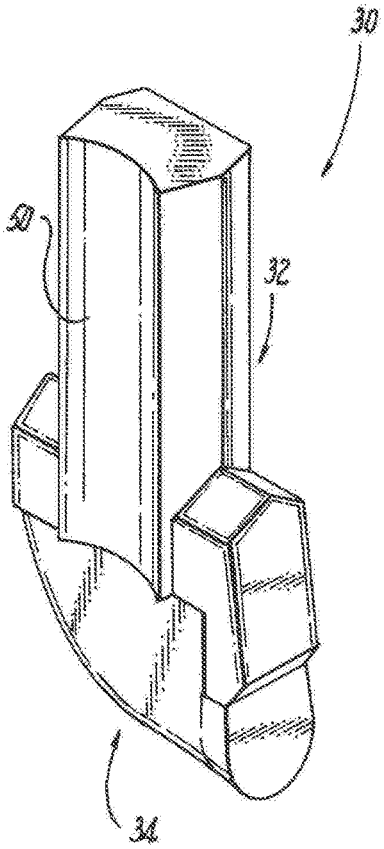

HELICAL PILE WITH CUTTING TIP

CROSS REFERENCE TO RELATED APPLICATIONS

This application is a continuation of application Ser. No. 15/343,642 filed on Nov. 4, 2016 (now U.S. Pat. No. 10,458,089), and claims benefit from U.S. Provisional Application Ser. No. 62/251,728 filed Nov. 6, 2015 the contents of both are herein incorporated by reference in their entirety.

BACKGROUND

Field

The present disclosure relates generally to helical piles and more particularly to helical piles with one or more cutting tips at a distal end of the helical pile.

Description of the Related Art

Piles are used to support structures, such as buildings, when the soil underlying the structure would be too weak alone to support the structure. To effectively support a structure, a pile has to penetrate the soil to a depth where competent load-bearing stratum is found. Conventional piles can be cast in place by excavating a hole in the place where the pile is needed, or a hollow form can be driven into the ground where the pile is needed, and then filled with cement. These approaches are cumbersome and expensive.

Helical or screw piles are a cost-effective alternative to conventional cement piles because of the speed and ease at which a helical pile can be installed. Helical piles are rotated such that load bearing helical plates at the lower end of the pile effectively screw the pile into the soil to a desired depth. Loose to medium dense soils, fine to coarse sand and sandy gravel, as well as firm clay are the ground components that helical piles are designed to auger through. Obstructions in the ground, such as a rock, can stress the shaft of the helical pile or the helical plates attached to the shaft. With a conventional helical pile, when layered rock formations, bedrock or a large rock is encountered, it is often necessary to pull the helical pile out of the ground, and attempt to auger the helical pile to the correct depth from another point. In the event that a rock formation is quite large, moving the drilling location may not be a viable option. Another option could be pre-drilling a hole in the layered rock formations, bedrock or rock, but this is often costly, time consuming and generally unfeasible.

SUMMARY

The present disclosure relates to helical piles generally, and to leads for helical piles having one or more cutting tips secured to the distal end of the lead. The leads disclosed herein can be used as helical piles or anchors, and are capable of withstanding compression loads and tension loads while having the capability to cut through hard/dense soil, thin layered rock formations, weathered bedrock, and large rocks/cobbles.

In one exemplary embodiment, a lead for a helical pile includes, a shaft, at least one load bearing helical plate, and a single cutting tip. The shaft has an end portion and a head portion. The head portion is configured to connect to a helical pile extension or a pile drive system. The at least one load bearing helical plate is attached at, for example, the end portion of the shaft, and the single cutting tip is secured to a distal end of the end portion of the shaft. The cutting tip has a mounting portion and a cutting body. The mounting portion is secured to the distal end of the end portion of the shaft. The cutting body has a cutting bit that extends beyond the distal end of the end portion of the shaft. Preferably, the cutting bit is made at least in part of impregnated carbide steel.

In another exemplary embodiment, a lead for a helical pile includes a shaft having an end portion and a head portion, at least one load bearing helical plate, a first cutting tip and a second cutting tip. A distal end of the end portion of the shaft is preferably tapered. The head portion is constructed to connect to a helical pile extension or a pile drive system. The at least one load bearing helical plate is attached at, for example, the end portion of the shaft. In this embodiment, the first cutting tip is secured to a long end of the tapered distal end of the end portion, and the second cutting tip is secured to a short end of the tapered distal end of the end portion.

In one exemplary embodiment, a helical pile includes a lead and at least one extension. The lead comprises a lead shaft with an end portion and a head portion. The head portion of the lead is configured to connect to the extension. The lead also comprises at least one load bearing helical plate attached at, for example, the end portion of the lead shaft, and a single cutting tip that is secured to a distal end of the end portion of the shaft. The at least one extension has an extension shaft with an end portion configured to connect to the head portion of the lead, and a head portion.

In another exemplary embodiment, a helical pile includes a lead and at least one extension. The lead includes a shaft having an end portion and a head portion, at least one load bearing helical plate, a first cutting tip and a second cutting tip. A distal end of the end portion of the shaft is preferably tapered. The head portion is constructed to connect to a helical pile extension or a pile drive system. The at least one load bearing helical plate is attached at, for example, the end portion of the shaft. In this embodiment, the first cutting tip is secured to a long end of the tapered distal end of the end portion, and the second cutting tip is secured to a short end of the tapered distal end of the end portion. The at least one extension has an extension shaft with an end portion configured to connect to the head portion of the lead, and a head portion.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein:

FIG. 6 is a perspective view of another exemplary embodiment of a lead for helical piles according to the present disclosure with multiple helical plates along a length of a round lead shaft and a cutting tip at a distal end of the lead shaft;

FIG. 7 is a perspective view of the distal end of the lead with a round shaft of FIG. 6, with the cutting tip separated from the distal end of the lead shaft;

FIG. 8 is a perspective view of the distal end of the lead of FIG. 7 illustrating a cutting tip separated from the distal end of the round lead shaft where the cutting tip is shaped to mate with the round lead shaft;

FIG. 9 is a front perspective view of the cutting tip of FIG. 9; and

DETAILED DESCRIPTION

The present disclosure provides helical piles and leads for helical piles having a cutting tip secured to the distal end of the lead. The leads disclosed herein can be used as helical piles or anchors, and are capable of withstanding compression loads and tension loads, while having the capability to cut through hard/dense soil, thin layered rock formations, weathered bedrock, and large rocks/cobbles. Reference herein to helical lead and helical piles also includes helical anchors.

Figure 1:
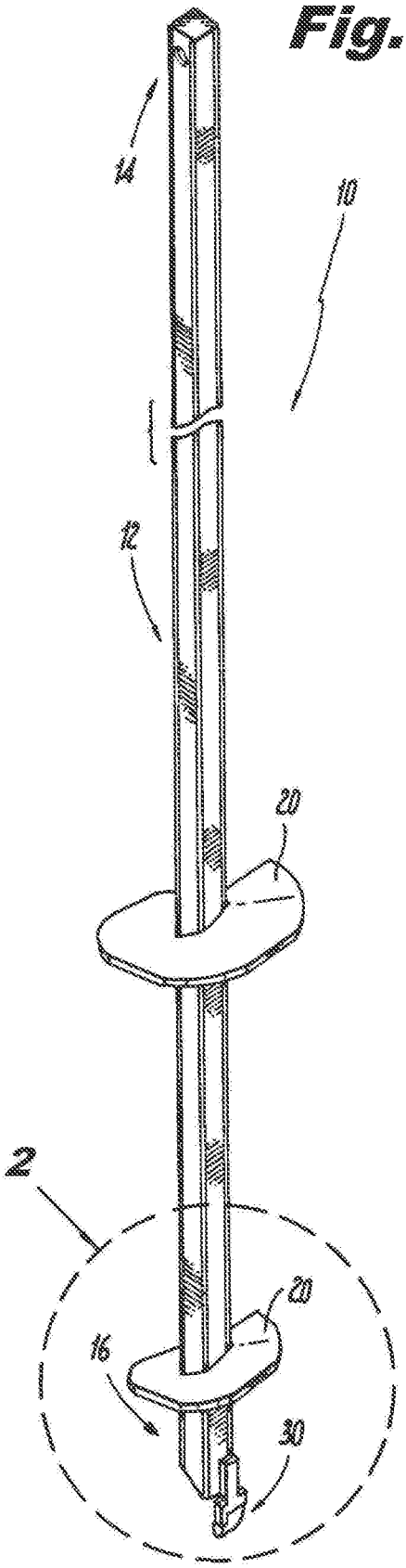
FIG. 1 is a perspective view of an exemplary embodiment of a lead for helical piles according to the present disclosure with multiple helical plates along a length of a square lead shaft and a cutting tip at a distal end of the lead shaft.

Referring to FIGS. 1 and 6, a helical pile 10 typically comprises square shafts, seen in FIG. 1, or round shafts, seen in FIG. 6, sequentially joined together. The shafts are typically hollow, but they may also be solid shafts. The bottom most shaft of a helical pile is known as the lead 12, which has a lead head portion 14 and a lead end portion 16. Additional shafts attached to the lead 12 are known as extensions. The lead head portion 14 connects to the extensions or to a pile drive system head used to rotate the lead and extensions, if used, to drive the helical pile into the soil. The lead and extensions can be made of metal, e.g., steel or galvanized steel, or carbon fiber, or other suitable material known in the art.

The lead end portion 16 is configured to first penetrate the soil and terminates with a tapered or beveled edge at its distal end. The lead 12 typically has one or more spaced apart load bearing helical plates 20 arranged on the lead shaft typically in the lead end portion 16 to penetrate the soil. The load bearing helical plates 20 on the lead may have the same diameter or the load bearing helical plates may have different diameters that are in a tapered arrangement. For example, the tapered arrangement may be such that the smallest diameter load bearing helical plate is closest to the tapered tip of the lead, and the largest load bearing helical plate is at a distance away from the tapered tip. The load bearing helical plates 20 on the lead 12 are spaced apart at a distance sufficient to promote individual plate load bearing capacity. Typically, the distance between the helical plates is three times the diameter of the smallest load bearing helical plate on the shaft of the lead. The diameter of the load bearing helical plates in conventional helical piles may range from between about 6 inches and about 16 inches depending upon the load the helical pile is to carry.

Helical piles 10 are installed by applying torque, via a pile drive system (not shown), to the shaft at the lead head 14 that causes the load bearing helical plates 20 to rotate and screw into the soil with minimal disruption to the surrounding soil. As the lead 12 penetrates the soil, one or more extensions (not shown) may have to be added to the helical pile 10 so that the pile can achieve the desired depth and load capacity. The extensions have an extension end portion and an extension head portion that are configured to connect to a lead head portion 14 and/or another extension or to the pile drive system, typically with a nut and bolt. The extensions may also have load bearing helical plates spaced apart at a distance sufficient to promote individual plate load bearing capacity. The distance is typically three times the diameter of the smallest load bearing helical plate on the shaft of the extension. The diameter of the load bearing helical plates in conventional helical pile extensions may range from between about 6 inches and about 16 inches depending upon the load the pile is to carry. Typically, the load bearing helical plates on an extension are the same diameter as the largest load bearing helical plate on the lead 12.

Figure 2:
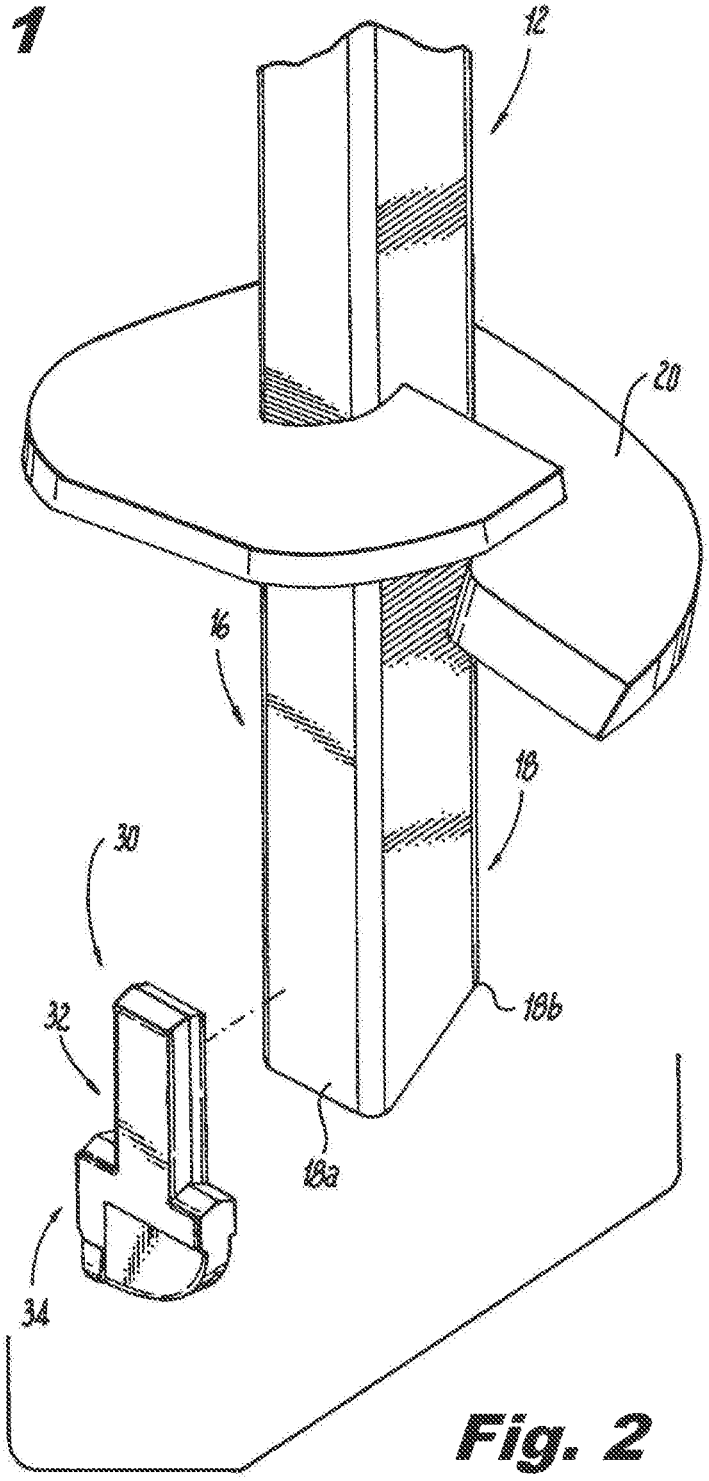
FIG. 2 is a perspective view of the distal end of the lead of FIG. 1, with the cutting tip separated from the distal end of the lead shaft.

Referring to FIGS. 2 and 7, the distal end 18 of the lead end portion 16 is, in one exemplary embodiment, tapered or beveled so that it has a long end 18*a* and a short end 18*b*, as shown. Using a tapered or beveled end at the distal end 18 of the lead end portion 16 provides at least two operations. First, the tapered or beveled end provides a piercing function that helps the lead 12 penetrate soil, and second, the tapered or beveled distal end allows the resulting debris, e.g., soil, rock chips and other debris, to more easily be forced out or laterally displaced from the path of the shaft while the helical pile is being driven into the soil.

Referring again to FIGS. 2-7, secured to the long end 18*a* of the lead end portion 16 is a cutting tip 30. The cutting tip 30 has a mounting portion 32 and a body portion 34. In the embodiments shown, the mounting portion 32 of the cutting tip 30 is secured to the long end 18*a* of the lead end portion 16 by welding, or any other suitable method that is sufficient to secure the cutting tip to the lead 12 and to withstand the torque and other forces applied to the cutting tip when the helical pile is being driven into the soil and cutting through rock. The thickness of the mounting portion 32 can be, for example, in the range of about ¼ inch and about 1 inch. When using round shafts for the helical pile 10, the mounting portion 32 of the cutting tip 30 may include a curved or an arcuate edge 50, shown in FIGS. 8 and 9, on the side of the cutting tip that contacts the shaft that is shaped to conform to the outer peripheral edge of the round shaft. The curved edge 50 provides more surface area for securing the cutting tip 30 to the shaft by, for example, welding, or any other suitable method that is sufficient to secure the cutting tip to the lead 12 and to withstand the torque and other forces applied to the cutting tip when the helical pile is being driven into the soil and cutting through rock.

Figure 3:
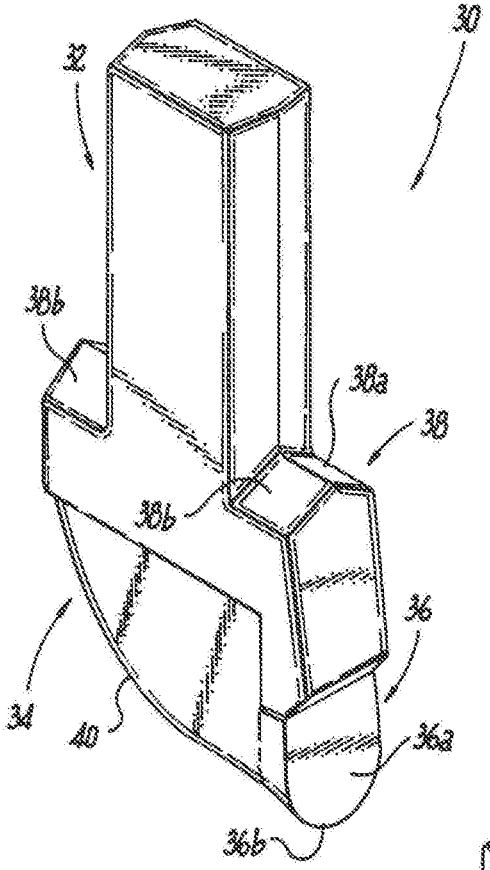
FIG. 3 is a front perspective view of an exemplary embodiment of a cutting tip according to the present disclosure.
Figure 4:
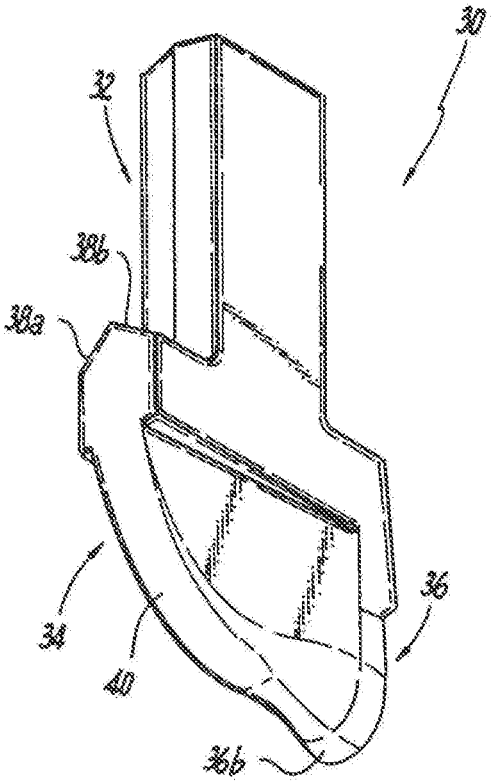
FIG. 4 is a rear perspective view of the cutting tip of FIG. 3.
Figure 5:
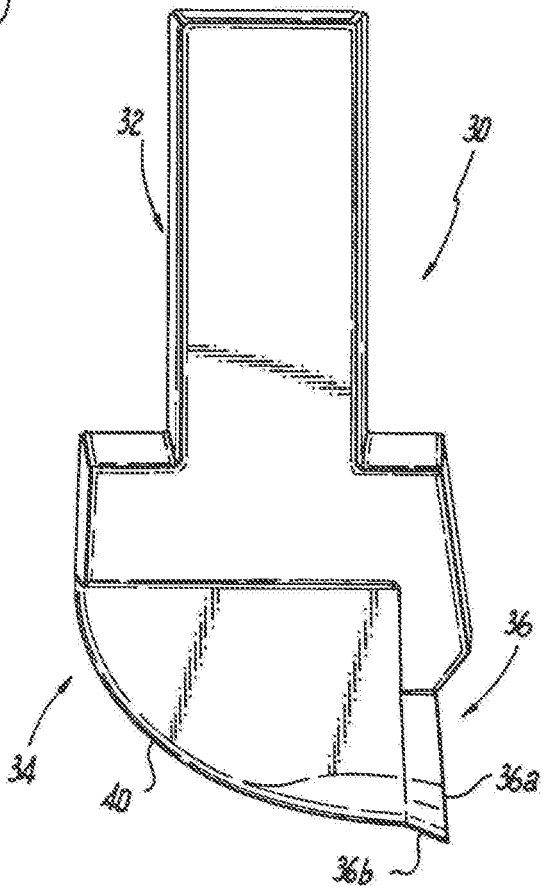
FIG. 5 is a side perspective view of the cutting tip of FIG. 3.

As seen in FIGS. 3-5, the cutting body 34 comprises a cutting bit 36 formed by front surface 36*a* and a bottom surface 36*b* that is tapered or beveled distally relative to the front surface 36*a* to form a cutting edge that extends below the cutting body 34, as seen in FIG. 5. The thickness of the cutting body 34 is in, for example, the range of about ¼ inch and about 1 inch. The cutting bit 36 can be made of impregnated carbide steel of an amount sufficient to cut through rock and withstand the torque and other forces applied to the cutting tip when the helical pile 10 is being driven into the soil. As an example, a layer of tungsten carbide, titanium carbide, vanadium carbide, or other like hard material/compound can be electrodeposited at least on the cutting bit 36, i.e., the front face 36*a* and the bottom surface 36*b*, to provide an anti-abrasion and wear-resistant surface. Alternatively, the cutting tip 30 or the cutting body 34 can be electrodeposited with a layer of tungsten carbide, titanium carbide, vanadium carbide, or other like hard material/compound.

In the exemplary embodiment shown in FIGS. 3-5, a top surface 38 of the cutting body 34 comprises a pair of sloped sides 38*a* and 38*b* that join at an apex generally in the center of the top surface 38. Sloped sides 38*a* and 38*b* help prevent debris, e.g., soil and broken rock, from building on the top surface so that the cutting edge 36 is clear of debris while cutting through the rock. As shown in FIGS. 4 and 5, the cutting body area 40 behind the cutting bit 36 is tapered from the front of the cutting tip to the rear of the cutting tip to minimize binding that may be caused by debris when the helical pile is being driven into the soil.

Referring again to FIGS. 1 and 6, the cutting body 34 of the cutting tip 30 extends beyond the distal end 18 of the lead end portion 16 of the lead 12. As noted, the mounting portion 32 of the cutting tip 30 is preferably welded to the long end 18*a* of the lead end portion 16 so that the cutting body 34, and thus the cutting edge 36 of the cutting tip face the direction of rotation of the helical pile so that the cutting tip 30 can engage the soil, weathered rock, rock lenses, layered rock formations, bedrock, large rocks and/or debris and cut through the weathered rock, rock lenses, layered rock formations, bedrock and/or large rocks sufficiently so that the lead shaft and following helical plates 20 can then penetrate the soil, weathered rock, rock lenses, layered rock formations, bedrock and/or large rocks.

In operation, when the lead 12 is first being driven into the soil, the cutting tip 30 and tapered or beveled end at the distal end 18 of the lead end portion 16 rotate and initially penetrate the soil. As the lead is rotated the helical plates thread through the soil. If, for example, a layered rock formation is encountered by the lead 12, the cutting edge 36 of the cutting tip 30 begins to cut, break and/or loosen the soil and layered rock formation. As the cutting edge 36 cuts through the rock and soil, the cutting tip 30 and tapered or beveled end at the distal end 18 of the lead end portion 16 are rotating forcing or displacing the soil and rock debris laterally to the side to make room for the shaft so that the cutting edge can continuously cut, break and/or loosen new layered rock. As the cutting tip 30 and distal end 18 of the lead 12 bore a hole through the layered rock formation, the helical plate 20 engages the layered rock formation and begins to penetrate the cut, broken and/or loosened layered rock formation. By having a cutting tip 30 secured to the lead 12, a cutting channel is formed by the rotating cutting tip 30, and the tapered or beveled end at the distal end 18 of the lead end portion 16 displaces the soil and rock from the path of the cutting edge 36.

Figure 10:
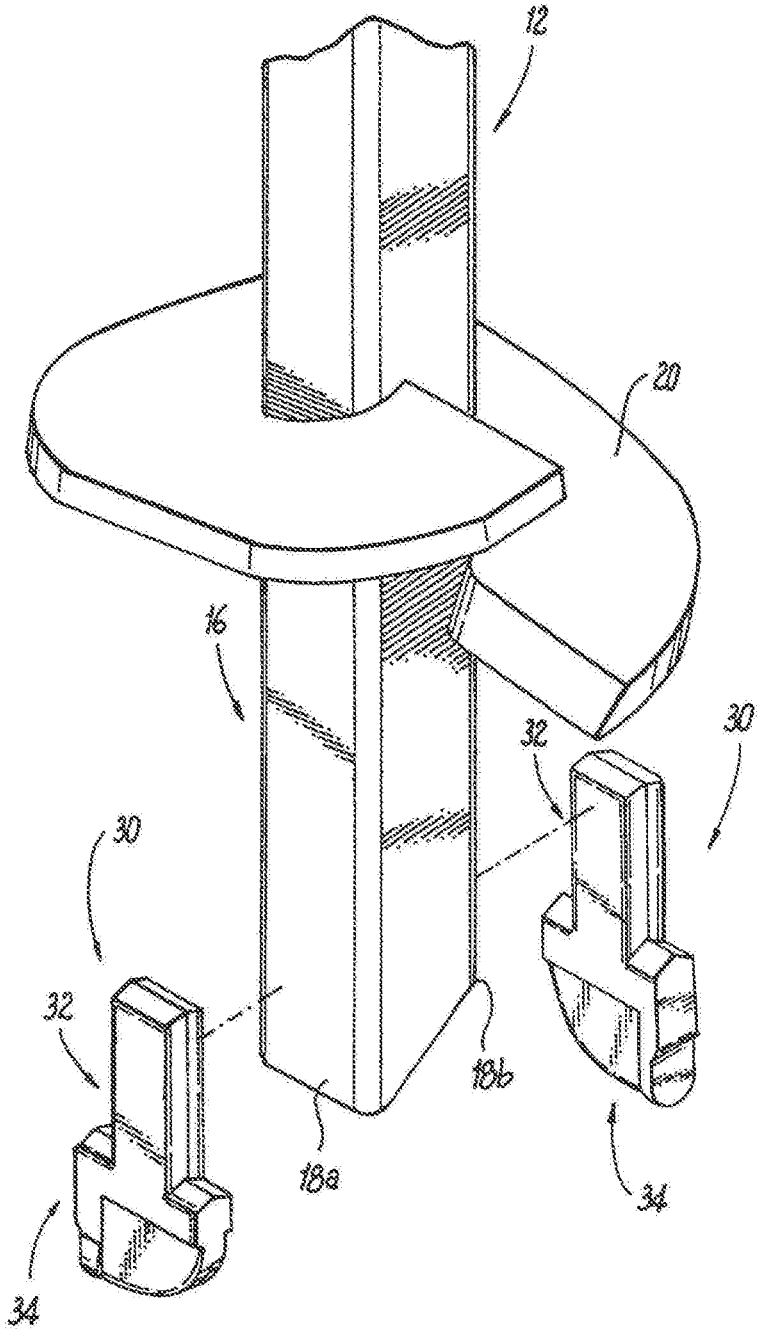
FIG. 10 is a perspective view of the distal end of another exemplary embodiment of a lead for helical piles according to the present disclosure with multiple cutting tips separated from the distal end of the lead shaft.

Referring to FIG. 10, another exemplary embodiment of a lead end portion 16 of the lead 12 is shown. In this exemplary embodiment, the distal end 18 of the lead end portion 16 is also tapered or beveled so that it has a long end 18*a* and a short end 18*b*. Using a tapered or beveled end at the distal end 18 of the lead end portion 16 provides at least two operations. First, the tapered or beveled end provides a piercing function the helps the lead 12 penetrate soil, and second, the tapered or beveled distal end helps to remove debris, e.g., soil, rock chips and other debris, from the path of the shaft while the helical pile is being driven into the soil. In addition, the distal end 18 of the lead end portion 16 includes two cutting tips 30. A first cutting tip 30 is secured to the long end 18*a* of the lead end portion 16 and a second cutting tip 30 is secured to the short end 18*b* of the lead portion. Each cutting tip 30 has a mounting portion 32 and a body portion 34 as described above. The mounting portion 32 of the first cutting tip 30 is secured to the long end 18*a* of the lead end portion 16 by welding or any other suitable method that is sufficient to secure the cutting tip to the lead 12 and to withstand the torque and other forces applied to the cutting tip when the helical pile is being driven into the soil and cutting through rock. The mounting portion 32 of the second cutting tip 30 is secured to the short end 18*b* of the lead end portion 16 by welding or any other suitable method that is sufficient to secure the cutting tip to the lead 12 and to withstand the torque and other forces applied to the cutting tip when the helical pile is being driven into the soil and cutting through rock. By mounting the cutting tips on the long end 18*a* and short end 18*b* of the lead end portion 16, the body portions 34 of the cutting tips 30 are offset or at different heights relative to each other.

With this offset, when the lead 12 is first being driven into the soil, the first cutting tip, second cutting tip and the tapered or beveled end at the distal end 18 of the lead end portion 16 rotate and initially penetrate the soil. As the lead is rotated, the helical plates thread through the soil. If, for example, a layered rock formation is encountered by the lead, the cutting edge 36 of the first cutting tip 30 begins to cut, break and/or loosen the layered rock formation. As the cutting edge 36 of the first cutting tip 30 cuts, breaks and/or loosens the rock, the cutting edge 36 of the second cutting tip 30 begins to cut, break and/or loosen the layered rock formation and to further break the rock cut by the first cutting tip 30. At the same time, the cutting tips and tapered or beveled end at the distal end 18 of the lead end portion 16 are rotating and displacing the soil and debris laterally to the side from the path of the shaft so that the cutting edges can continuously cut, break and/or loosen new layered rock. As the two cutting tips 30 and the distal end 18 of the lead 12 bore a hole through the layered rock formation, the helical plate 20 engages the layered rock formation and begins to penetrate the cut, broken and/or loosened layered rock formation. By having two cutting tips 30 secured to the lead 12, a cutting channel is formed by the rotating cutting tips 30 and the tapered or beveled end at the distal end 18 of the lead end portion 16 displaces the soil and rock from the path of the cutting edges 36 of the cutting tips.

While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A lead for a helical pile, the lead comprising:

a shaft having an end portion and a head portion;

at least one load bearing helical plate attached at the end portion of the shaft; and at least two cutting tips, each cutting tip including:

a mounting portion secured to an exterior of the end portion of the shaft; and a body portion extending from the mounting portion and below a bottom surface of the shaft, the body portion having a cutting bit and a cutting body area adjacent the cutting bit, the cutting body area having a front portion adjacent the cutting bit and a rear portion spaced from the front portion by a pair of side walls, wherein the pair of side walls are tapered from the front portion to the rear portion such that a cross-sectional thickness between the side walls at the front portion is greater than a cross-sectional thickness between the side walls at the rear portion, the cutting bit having a front surface and a bottom surface, the bottom surface of the cutting bit extending below the front portion of the cutting body area and being tapered from the front surface of the cutting bit to the front portion of the cutting body area.

2. The lead according to claim 1, wherein an edge of the mounting portion secured to an exterior of the end portion of the shaft comprises a flat edge or a rounded edge.

3. The lead according to claim 1, wherein the cutting bit is made at least in part of impregnated carbide steel.

4. The lead according to claim 1, wherein the at least one load bearing helical plate comprises a plurality of load bearing helical plates.

5. The lead according to claim 1, wherein a cross-section of the shaft is square.

6. The lead according to claim 1, wherein a cross-section of the shaft is round.

7. A helical pile, comprising:

a lead comprising, a lead shaft with an end portion and a head portion;

at least one load bearing helical plate attached at the end portion of the lead shaft; and at least two cutting tips, each cutting tip including:

a mounting portion secured to an exterior of the end portion of the lead shaft; and a body portion extending from the mounting portion and below a bottom surface of the lead shaft, the body portion having a cutting bit and a cutting body area adjacent the cutting bit, the cutting body area having a front portion adjacent the cutting bit and a rear portion spaced from the front portion by a pair of side walls, wherein the pair of side walls are tapered from the front portion to the rear portion such that a cross-sectional thickness between the side walls at the front portion is greater than a cross-sectional thickness between the side walls at the rear portion, the cutting bit having a front surface and a bottom surface, the bottom surface of the cutting bit extending below the front portion of the cutting body area and being tapered from the front surface of the cutting bit to the front portion of the cutting body area; and an extension having an extension shaft with an end portion configured to connect to the head portion of the lead shaft, and a head portion.

8. The helical pile according to claim 7, wherein an edge of the mounting portion secured to an exterior of the end portion of the lead shaft comprises a flat edge or a rounded edge.

9. The helical pile according to claim 7, wherein the cutting bit is made at least in part of impregnated carbide steel.

10. The helical pile according to claim 7, wherein a cross-section of the lead shaft is square.

11. The helical pile according to claim 7, wherein a cross-section of the lead shaft is round.

12. The helical pile according to claim 7, wherein the at least one load bearing helical plate attached at the end portion of the lead shaft comprises a plurality of load bearing helical plates.

13. A lead for a helical pile, the lead comprising:

a shaft having an end portion and a head portion;

at least one load bearing helical plate attached at the end portion of the shaft;

a first cutting tip including:

a first mounting portion secured to the end portion; and a first body portion extending from the first mounting portion and below the bottom surface of the end portion of the shaft, the first body portion including a first cutting bit and a first cutting body area adjacent the first cutting bit, the first cutting body area having a front portion adjacent the first cutting bit and a rear portion spaced from the front portion by a first pair of side walls, wherein the first pair of side walls are tapered from the front portion to the rear portion such that a cross-sectional thickness between the side walls at the front portion is greater than a cross-sectional thickness between the side walls at the rear portion, the first cutting bit having a front surface and a bottom surface, the bottom surface of the first cutting bit extending below the front portion of the first cutting body area and being tapered from the front surface of the first cutting bit to the front portion of the first cutting body area; and a second cutting tip including:

a second mounting portion secured to the end portions; and a second body portion extending from the second mounting portion and below the bottom surface of the end portion of the shaft, the second body portion including a second cutting bit and a second cutting body area adjacent the second cutting bit, the second cutting body area having a front portion adjacent the second cutting bit and a rear portion spaced from the front portion by a second pair of side walls, wherein the second pair of side walls are tapered from the front portion to the rear portion such that a cross-sectional thickness between the side walls at the front portion is greater than a cross-sectional thickness between the side walls at the rear portion, the second cutting bit having a front surface and a bottom surface, the bottom surface of the second cutting bit extending below the front portion of the second cutting body area and being tapered from the front surface of the second cutting bit to the front portion of the second cutting body area.

14. The lead according to claim 13, wherein the first cutting bit and the second cutting bit are offset.

15. The lead according to claim 13, wherein an edge of the first mounting portion secured to the end portion of the shaft comprises a flat edge or a rounded edge, and wherein an edge of the second mounting portion secured to the end portion of the shaft comprises a flat edge or a rounded edge.

16. The lead according to claim 13, wherein the first cutting bit and the second cutting bit are made at least in part of impregnated carbide steel.

17. The lead according to claim 13, wherein the at least one load bearing helical plate attached at the end portion of the shaft comprises a plurality of load bearing helical plates.

18. The lead according to claim 13, wherein a cross-section of the shaft is square.

19. The lead according to claim 13, wherein a cross-section of the shaft is round.

* * * * *